US008857508B2

(12) United States Patent
Mazyar

(10) Patent No.: US 8,857,508 B2
(45) Date of Patent: Oct. 14, 2014

(54) VALVE ASSEMBLY

(75) Inventor: Oleg A. Mazyar, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 488 days.

(21) Appl. No.: 13/361,039

(22) Filed: Jan. 30, 2012

(65) Prior Publication Data

US 2013/0192852 A1 Aug. 1, 2013

(51) Int. Cl.
*E21B 31/06* (2006.01)
*E21B 23/00* (2006.01)
*E21B 34/00* (2006.01)

(52) U.S. Cl.
USPC ..... 166/66.5; 166/66.6; 166/316; 166/373

(58) Field of Classification Search
USPC ..... 166/65.5, 66.6, 386, 316, 373; 251/65, 251/129.01, 129.06; 977/773
See application file for complete search history.

(56) References Cited

U.S. PATENT DOCUMENTS 2,743,898 A * 5/1956 King, Jr. ..... 251/129.21
3,982,722 A * 9/1976 Bernard ..... 251/4
6,802,489 B2 * 10/2004 Marr et al. ..... 251/129.14
7,338,028 B2 * 3/2008 Zimmerling et al. ..... 251/7
7,547,415 B2 * 6/2009 Hataoka et al. ..... 422/552
8,020,586 B2 * 9/2011 Delamarche ..... 137/831
8,051,878 B2 * 11/2011 Delamarche ..... 137/831
8,424,598 B2 * 4/2013 Roddy ..... 166/248
2003/0116738 A1 * 6/2003 O'Connor et al. ..... 251/129.14
2011/0297394 A1 * 12/2011 VanDelden ..... 166/373
2012/0186813 A1 * 7/2012 Ohta ..... 166/285
2012/0318510 A1 * 12/2012 Ocalan ..... 166/300

OTHER PUBLICATIONS

Feng Du et al., "Membranes of Vertically Aligned Superlong Carbon Nanotubes," Lamgmuir, 2011, vol. 27, pp. 8437-8443.

* cited by examiner

*Primary Examiner* — Kenneth L Thompson
*Assistant Examiner* — Michael Wills, III
(74) *Attorney, Agent, or Firm* — Cantor Colburn LLP

(57) ABSTRACT

A downhole valve assembly including at least one membrane permeable to a flow of a downhole fluid, the at least one membrane defining a passage through a chamber. A quantity of particles is disposed in the chamber and the at least one membrane is impermeable to the particles. The particles are responsive to a magnetic field. At least one magnetic element is operatively arranged to produce the magnetic field for enabling the at least one magnetic element to selectively move the particles between a first position at which the particles impede the flow of the downhole fluid through the at least one membrane and a second position at which the particles do not impede the flow of the downhole fluid through the at least one membrane. A method of controlling a flow of fluid is also included.

19 Claims, 1 Drawing Sheet

VALVE ASSEMBLY

BACKGROUND

Valves and fluid flow control devices are ubiquitous in the downhole drilling and completions industry. For example, the elimination of water during the production of hydrocarbons is often desired. A variety of valves and other devices are known and used for eliminating water or otherwise controlling downhole fluid flows, but naturally come with various tradeoffs between cost, effectiveness, longevity, ease of installation, reliability, etc. Accordingly, the industry is always desirous of alternative devices for assisting in the control of fluids while performing downhole operations.

SUMMARY

A downhole valve assembly, including at least one membrane permeable to a flow of a downhole fluid, the at least one membrane defining a passage through a chamber, a quantity of particles disposed in the chamber, the at least one membrane impermeable to the particles and the particles being responsive to a magnetic field, and at least one magnetic element operatively arranged to produce the magnetic field for enabling the at least one magnetic element to selectively move the particles between a first position at which the particles impede the flow of the downhole fluid through the at least one membrane and a second position at which the particles do not impede the flow of the downhole fluid through the at least one membrane.

A method of controlling a flow of fluid between a first location and a second location in a downhole environment including controlling a condition of at least one magnetic element, moving a quantity of particles magnetically responsive to the at least one magnetic element between a first position relative a membrane and a second position relative the at least one membrane, the at least one membrane being permeable to a flow of a downhole fluid and impermeable to the particles, and selectively impeding the flow of the downhole fluid through the at least one membrane, with the particles impeding the flow of the downhole fluid through the at least one membrane when in the first position and not impeding the flow of the downhole fluid through the at least one membrane when in the second position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
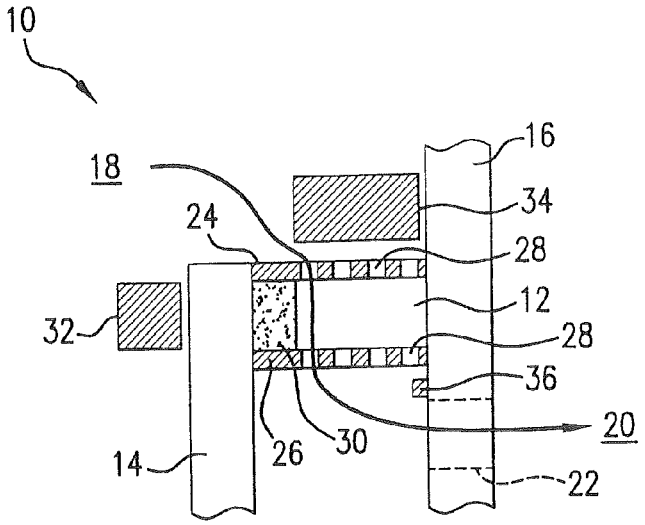
FIG. 1 is a cross-sectional view of a valve assembly in an open position.

Referring now to FIG. 1, a downhole valve assembly 10 is shown. The valve assembly 10 includes a valve chamber 12 that is disposed between a pair of fluid barriers 14 and 16. For example, in one embodiment the barriers 14 and 16 are tubulars in a production assembly for producing one or more fluids, e.g., hydrocarbons. As will be better appreciated in view of the description below, the valve assembly 10 enables selective control over the flow of fluid between a set of downhole locations 18 and 20. For example, in one embodiment, the location 18 is within a production tubing string, while the location 20 is in or adjacent to a downhole formation, reservoir, annulus, etc. (i.e., the barrier 16 being a production tubular having at least one perforation 22).

The valve chamber 12 is also formed by a set of wall members 24 and 26 that include membranes 28 therein. The membranes 28 are permeable with respect to downhole fluids for enabling the flow of downhole fluids through the chamber 12. The membranes 28 thereby essentially form inlets into and outlets from the chamber 12 for enabling the aforementioned fluid flow and communication between the locations 18 and 20. The membranes 28 could be located as multiple discrete portions, a single portion, or the entirety of the wall members 24 and 26, as desired in various embodiments.

Figure 2:
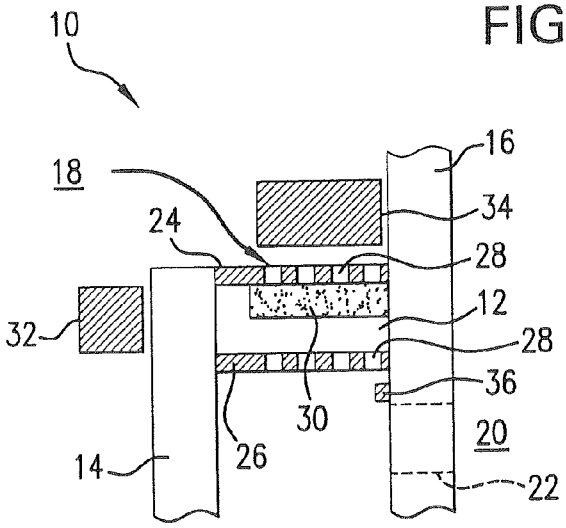
FIG. 2 is a cross-sectional view of the valve assembly of FIG. 1 in a closed position according to one embodiment disclosed herein.

Although permeable to downhole fluids, the membranes 28 are impermeable with respect to a quantity of particles 30 held in the chamber 12. The particles 30 are selected such that they are responsive to magnetic fields. For example, the particles 30 could be ferromagnetic, paramagnetic, superparamagnetic, etc. In the illustrated embodiment, a pair of magnetic elements 32 and 34 is included to control the positioning of the particles 30, which enables the valve assembly 10 to control the flow of fluid therethrough. For example, in FIG. 1 the magnetic elements 32 and 34 are configured to urge the particles 30 toward the element 32, thereby opening the valve assembly 10, while in FIG. 2 the magnetic elements 32 and 34 are configured to urge the particles 30 toward the magnetic element 34, thereby closing the valve assembly 10. That is, when the particles 30 are moved toward, e.g., attracted to, the magnetic element 32, as shown in FIG. 1, the membranes 28 are not affected by the particles 30 and fluid can flow through the membranes 28. Oppositely, when attracted by the magnetic element 34, the particles 30 surround the membranes 28 in the wall member 24 in order to block, obstruct, hinder, or otherwise impede the flow of fluid into the chamber 12, and therefore, to prevent the flow of fluid between the locations 18 and 20.

As shown in the illustrated embodiment, the magnetic elements 32 and 34 are arranged substantially perpendicularly with respect to each other, such that one element, e.g., the element 32, can position the particles 30 off to the side and enable the fluid to flow unobstructed in a straight path through the chamber 12. In this way, the positioning of the particles 30, as set by the magnetic elements 32 and 34, enables the valve assembly 10 to selectively enable and prevent the flow of downhole fluids therethrough. The barrier 14 can be made, for example, from a dielectric and/or non-magnetically responsive material so as not to interfere with the performance of the magnetic element 32. In other embodiments, the magnets could be arranged in orientations other than perpendicular, e.g., at various angles such as 30°, 60°, 120°,etc. In another embodiment, the wall members 24 and 26 could be formed in a unparallel manner, with the magnetic elements 32 and 34 being parallel to each other. It is to be appreciated that other arrangements are possible for selectively closing/opening one or more membranes by use of magnetic elements controlling the positioning of magnetic particles as described herein.

In one embodiment, the membranes 28 are formed from super long vertically aligned carbon nanotubes (SLVA-CNT).

Membranes made from SLVA-CNT have been shown to be permeable to water, hexane, dodecane, and other liquids. In other embodiments, other porous materials, e.g., foams having appropriate porosities and pores sizes (i.e., that enable fluid flow but restrict passage of the particles 30), other nanoparticle compositions, e.g., aligned boron nitride, metal and metal oxide nanotubes, can be used. For example, various nanotube alignment methods that may be suitable in the production of the membranes 28 are taught in Mu, C., Yu, Y.-X., Wang, R. M., Wu, K., Xu, D. and Guo, G.-L. (2004), "Uniform Metal Nanotube Arrays by Multistep Template Replication and Electrodeposition", Advanced Materials, vol. 16, pp. 1550-1553; and in Chia Cheng Wu, Dong Sing Wuu, Po Rung Lin, Tsai Ning Chen, and Ray Hua Horng, "Three-Step Growth of Well-Aligned ZnO Nanotube Arrays by Self-Catalyzed Metalorganic Chemical Vapor Deposition Method", Cryst. Growth Des., 2009, vol. 9 (10), pp. 4555-4561; and in Takeshi Terao, Chunyi Zhi, Yoshio Bando, Masanori Mitome, Chengchun Tang and Dmitri Golberg, "Alignment of Boron Nitride Nanotubes in Polymeric Composite Films for Thermal Conductivity Improvement", J. Phys. Chem. C, 2010, vol. 114 (10), pp 4340-4344; and in A. W. Maijenburg, M. G. Maas, E. J. B. Rodijk, W Ahmed, E. S. Kooij, E. T. Carlen, D. H. A. Blank, J. E. ten Elshof, "Dielectrophoretic alignment of metal and metal oxide nanowires and nanotubes: A universal set of parameters for bridging prepatterned microelectrodes", Journal of Colloid and Interface Science, vol. 355 (2011), pp. 486-493; etc.). SLVA-CNT and other nano-structures may be embedded in a matrix, e.g., a polymer, resin, epoxy, metal, ceramic, composite, etc. in order to form the membranes. The particles 30 could take various sizes, e.g., micro, macro, etc., or arranged in a slurry or mixture containing any combination of nano-, micro-, and macro-sized particles, particularly depending on the pore or opening sizes of the membranes 28 that enable fluid permeability.

In one embodiment the particles 30 take the form of nanoparticles, as these have been shown to provide good fluid impedance, particularly when used in combination with SLVA-CNT membranes. In one embodiment, the particles 30 are iron, iron-carbon, and/or iron-nitrogen nanoparticles synthesized or prepared by chemical vapor condensation as described in Chul-Jin Choi, Byoung-Kee Kim, Oleg Tolochko and Li-Da, "Preparation and Characterization of Magnetic Fe, Fe/C and Fe/N Nanoparticles Synthesized by Chemical Vapor Condensation Process", Reviews on Advanced Materials Science, vol. 5, pp. 487-492 (2003), or any other known or suitable process for creating magnetic nanoparticles, e.g., arc discharge, mechanical alloying, hydrogen plasma metal reaction, etc. In another embodiment, the particles 30 are magnetic noble metal nanoparticles, e.g., fabricated by conventional noble metal nanoparticle creation processes in the presence of a magnetic field as described in Krishna N. K. Kowlgi, Ger J. M. Koper, Stephen J. Picken, Ugo Lafont, Lian Zhang, and Ben Norder, "Synthesis of Magnetic Noble Metal (Nano)Particles", Langmuir, vol. 27, pp. 7783-7787 (2011). In another embodiment the particles 30 are carbon-decorated Co and/or FePt nanoparticles prepared as described in Norman A. Luechinger, Norman Booth, Greg Heness, Sri Bandyopadhyay, Robert N. Grass, and Wendelin J. Stark, "Surfactant-Free, Melt-Processable Metal-Polymer Hybrid Materials: Use of Graphene as a Dispersing Agent", Advanced Materials, vol. 20, pp. 3044-3049 (2008) and in Nick Caiulo, Chih Hao Yu, Kai Man K. Yu, Chester C. H. Lo, William Oduro, Benedicte Thiebaut, Peter Bishop, and Shik Chi Tsang, "Carbon-Decorated FePt Nanoparticles", vol. 17, pp. 1392-1396 (2007), respectively. Carbon coated or decorated particles may be particularly useful in harsh and/or corrosive downhole environments. The particles 30, particularly when in the form of nanoparticles, can additionally include chemical functional groups to increase wettability (e.g., hydrophobicity, hydrophilicity, etc.), dispersibility, surface properties, compatibility, and other desirable properties. For example, the wettability of the particles 30 can be set by functional groups in order to prevent the particles 30 from aggregating or grouping together to an undesirable extent. That is, while some adhesion or attraction between the particles 30 may increase the ability to block fluid flow through the membranes 28, too much adhesion may reduce the flowability of particles 30 and result in the particles 30 clumping together and failing to cover the entire surface of the membranes 28. In one embodiment the particles 30 are carbon decorated nanoparticles that include functional groups for tailoring the properties of the particles 30.

Figure 3:
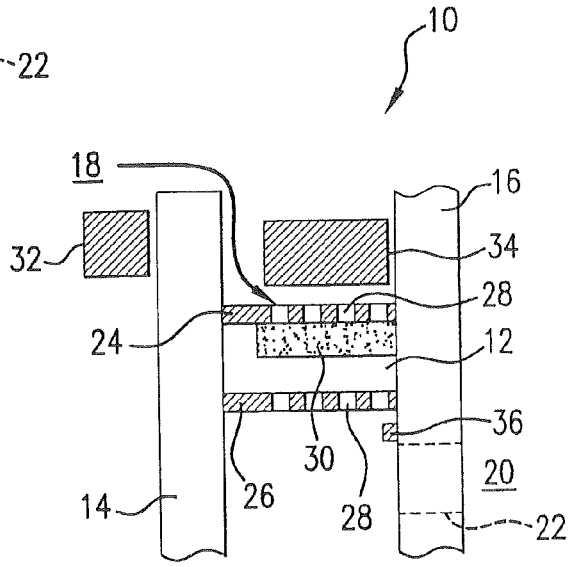
FIG. 3 is a cross-sectional view of the valve assembly of FIG. 1 in a closed position according to an alternate embodiment disclosed herein.

The magnetic elements 32 and 34 could be any combination of permanent and electromagnets. For example, if a permanent magnet and an electromagnet are used, the strength of the electromagnet can be set to be greater than that of the permanent magnet. In this embodiment, the electromagnet will attract the particles 30 more strongly when turned on and urge the particles 30 toward the electromagnet, while the particles 30 will instead be attracted by the permanent magnet when the electromagnetic is turned off If two electromagnets are used, then simply turning one on and the other off will enable control over the positioning of the particles 30. If two permanent magnets are used, then one or both of the magnets could be actuatable toward and away from the membranes 28 (e.g., affixed to a sliding sleeve or the like) for altering the magnetic forces experienced by the particles 30, thereby determining to which magnetic element the particles 30 are attracted. For example, in the embodiment shown in FIG. 3 the barrier 14 is a slideable sleeve sealed with the chamber 12 and having the element 32 secured thereto that enables the particles 30 to be attracted to the element 34 when the element 32 is moved into the position shown in FIG. 3. As another example that uses two permanent magnets, a slideable sleeve or other actuatable member could be used as a magnetic shield to "block", or more accurately reroute, magnetic field lines away from or around the membranes 28 for controlling the magnetic element to which the particles 30 are attracted. As another example, a single magnetic element could be used that is actuatable between a first position and a second position, with the first position attracting the particles 30 for enabling fluid flow and the second position attracting the particles to block or impede flow through the membranes 28. The direction of movement could be axial, rotational, etc. Of course, any embodiment that requires movement of the magnetic elements or some other members to control the condition of the valve assembly 10 will require a tool, e.g., a shifting tool, a plug (ball) and seat, etc., while embodiments using one or more stationary electromagnets can be controlled solely via electric signals, e.g., communicated via fiber optics, electrical wires, control lines, wireless signals, etc.

As noted above, the valve assembly 10 could be used in the production of hydrocarbons or other fluids. In such embodiments it may be advantageous to first filter or screen the fluid from the downhole location before reaching the membranes 28, e.g., so as not to block the membranes 28 with solids, damage the membranes 28, etc. For example, the current invention valve assemblies could be used with screen assemblies, filtering media, etc. The screens or filters could be conformable foam type screen, conventional mesh or wire screens, etc. As one example, the inflow control devices taught in U.S. Pat. No. 7,409,999 (Henriksen et al.), which Patent is hereby incorporated by reference in its entirety, could be adapted to include, or be replaced by, valve assemblies according to the current invention.

One or more sensors 36 are included in the illustrated embodiment for sensing and/or analyzing the flow of fluid through the chamber 12. In one embodiment the sensors 36 are electrically coupled to the magnetic elements 32 and/or 34, and configured to detect when a certain property or parameter of the flow of fluid ceases to be within an acceptable range. For example, the sensors 36 could be resistivity sensors used in a hydrocarbon production operation for determining when the percentage of water in the fluid flow becomes undesirably high. A signal can be sent for controlling the operation of the magnetic elements 32 and 34 (e.g., turning the elements on or off, moving the elements, etc.) and therefore the open/closed status of the valve assembly 10 upon detection of an unsuitable property or parameter either instantaneously or over some predetermined period of time. In this way, the valve 10 can automatically react in real time to changing conditions in the flow of fluid. In another embodiment, a signal could be manually sent, e.g., through a control line from a surface of a borehole in which the valve assembly 10 is used, for triggering or actuating the valve assembly 10.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole valve assembly, comprising:

at least one membrane permeable to a flow of a downhole fluid, the at least one membrane defining a passage through a chamber;

a quantity of particles disposed in the chamber, the at least one membrane impermeable to the particles and the particles being responsive to a magnetic field; and at least one magnetic element operatively arranged to produce the magnetic field for enabling the at least one magnetic element to selectively move the particles between a first position at which the particles impede the flow of the downhole fluid through the at least one membrane and a second position at which the particles do not impede the flow of the downhole fluid through the at least one membrane.

2. The assembly of claim 1, wherein the at least one magnetic element comprises a pair of magnetic elements.

3. The assembly of claim 2, wherein the pair of magnetic elements is arranged substantially perpendicular with respect to each other.

4. The assembly of claim 1, wherein the particles are ferromagnetic, superparamagnetic, paramagnetic, or a combination including at least one of the foregoing.

5. The assembly of claim 1, wherein the at least one membrane comprises super long vertically aligned carbon, boron nitride, metal and metal oxide nanotubes or a combination including at least one of the foregoing.

6. The assembly of claim 1, wherein the particles are nanoparticles.

7. The assembly of claim 6, wherein the nanoparticles are carbon decorated.

8. The assembly of claim 6, wherein the nanoparticles are functionalized.

9. The assembly of claim 1, wherein the flow of the fluid is between a downhole formation or reservoir and a production tubular.

10. The assembly of claim 1, further comprising at least one sensor for detecting a property or parameter of the flow of the fluid.

11. The assembly of claim 10, wherein the at least one sensor is configured to automatically send a signal for controlling the at least one magnetic element by setting a condition of the valve assembly upon detection of the property or parameter being out of a predetermined acceptable range.

12. The assembly of claim 1, wherein the at least one magnetic element includes a permanent magnet, an electromagnet, or a combination including at least one of the foregoing.

13. The assembly of claim 1, wherein the at least one membrane includes a plurality of membranes, at least one of which is included in each of at least two walls defining the chamber.

14. The assembly of claim 1, wherein the at least one magnetic element is disposed with a moveable member for altering a magnitude of the force experienced by the particles.

15. The assembly of claim 14, wherein the at least one magnetic element is secured to the movable member for altering a position of the at least one magnetic element relative to the chamber.

16. A method of controlling a flow of fluid between a first location and a second location in a downhole environment, comprising:

controlling a condition of at least one magnetic element;

moving a quantity of particles magnetically responsive to the at least one magnetic element between a first position relative a membrane and a second position relative the at least one membrane, the at least one membrane being permeable to a flow of a downhole fluid and impermeable to the particles; and selectively impeding the flow of the downhole fluid through the at least one membrane, with the particles impeding the flow of the downhole fluid through the at least one membrane when in the first position and not impeding the flow of the downhole fluid through the at least one membrane when in the second position.

17. The method of claim 16, wherein the first location is in a downhole formation or reservoir and the second location is inside a production tubular.

18. The method of claim 16, wherein the at least one membrane comprises super long vertically aligned carbon, boron nitride, metal, and metal oxide nanotubes, or a combination including at least one of the foregoing.

19. The method of claim 16, wherein the particles are nanoparticles.

* * * * *